United States Patent [19]

Donnelly et al.

[11] Patent Number: 4,973,086

[45] Date of Patent: Nov. 27, 1990

[54] RECORDS MANAGEMENT APPARATUS FOR CONSTRUCTING AND MAINTAINING A FILE FOLDER-BASED DOCUMENT FILING AND RETRIEVAL SYSTEM

[76] Inventors: Donald D. Donnelly; Nora J. Donnelly, both of 13150 Red Fern La., Dallas, Tex. 75240

[21] Appl. No.: 320,219

[22] Filed: Mar. 6, 1989

[51] Int. Cl.[5] ..... B42F 21/00

[52] U.S. Cl. ..... 283/37; 283/39; 283/43; 283/40; 283/41; 402/79; 281/38

[58] Field of Search ..... 283/37, 39, 43, 54, 283/36, 38, 40, 41, 42, 62; 281/2, 3, 8, 5; 402/79, 73, 70, 60, 80 R

[56] References Cited

U.S. PATENT DOCUMENTS

| | | | |
|---|---|---|---|
| 960,693 | 6/1910 | Perrine | 283/37 |
| 1,069,092 | 7/1913 | Wise | 283/37 |
| 4,221,404 | 9/1980 | Shuffstall | 283/37 |
| 4,445,711 | 5/1984 | Cunningham | 283/39 |
| 4,696,491 | 9/1987 | Stenger | 283/37 |
| 4,715,621 | 12/1987 | Calavito et al. | 283/36 |
| 4,832,374 | 5/1989 | Prest, Jr. | 283/37 |

*Primary Examiner*—Frank T. Yost
*Assistant Examiner*—Thomas Hamill, Jr.
*Attorney, Agent, or Firm*—Hubbard, Thurman, Turner, Tucker & Harris

[57] ABSTRACT

A records management kit for use in setting up and maintaining a cross-referenced, easily enterable, file folder—based document filing and retrieval system comprises a file guide book, an index sheet, a series of file folders, and a series of file folder labels. The file guide book has a series of tabbed page sets each including a main category page and subsequent subcategory pages. Each main category page has subcategory headings and associated file indicia marks printed thereon which correspond to similar information printed on the associated subcategory pages. The pages of the file guide book are color and indicia—keyed to the file folder labels and are also keyed to category, subcategory and file indicia information printed on the file index sheet together with an expanded listing of specific document types relating generally to the various categories and subcatergories. The detailed cross-referencing among the filing guide book, the index sheet and the file folder labels, when affixed to their respective file folders, permits a user to rapidly file or retrieve a particular document, even with no prior familiarity with the filing system, simply by using the file index sheet. Further information regarding suggested content or use of a particular file is additionally printed on the subcatergory pages of the file guide book, such information being rapidly and easily locatable using either the file index or correlated information marked on the labels.

19 Claims, 3 Drawing Sheets

RECORDS MANAGEMENT APPARATUS FOR CONSTRUCTING AND MAINTAINING A FILE FOLDER-BASED DOCUMENT FILING AND RETRIEVAL SYSTEM

BACKGROUND OF THE INVENTION

The present invention relates generally to document storage and retrieval apparatus and, in a preferred embodiment thereof, more particularly provides a records management kit which may be used to easily and rapidly construct and maintain a file folder-based document filing and retrieval system for home or business use.

The home or business filing, in conventional manila file folders or the like, of large numbers of unrelated documents often creates annoying and sometimes perplexing problems for the file user. Such problems representatively include difficulties in initially setting up the system, establishing usable file categories which are neither too broad nor too narrow, deciding which of the various filing categories to place a received document in, finding and retrieving a filed document, and expanding the initially created system to meet changing filing requirements.

Additionally, the filing system, when initially created and thereafter, is often unavoidably imbued with the personal organizational and operational preferences of the person which initially created it.

Assuming that the file creator is reasonably efficient and organized, the filing system may well operate satisfactorily —as long as the file creator remains primarily responsible for document filing and retrieval activities. However, as is well known, if another person unfamiliar with the system must use it, entry into and retrieval from the previously "personalized" system may be quite difficult for some time.

Various pre-organized filing systems of the file folder type have been previously proposed to provide at least some degree of standardization to document filing and retrieval. One common example, which is produced in several variations, is the "expandable folder" type of document filing apparatus which comprises an expandable pouch structure which is divided into a series of file pockets by pre-labeled divider panels.

This type of conventional document filing structure, while ostensibly providing at least a degree of organizational standardization, has a variety of well-known limitations and disadvantages. For example, its document containment volume is limited. Accordingly, it can rapidly become unusable and obsolete as the number of documents to be filed exceeds a certain level. Additionally, the pre-printed filing categories tend to be overly broad, resulting in user confusion over where to file a given document and where to find a previously filed document. Moreover, this category breadth, which allows an original file system user sometimes rather broad latitude in where in the structure to put a given document, often leads to subsequent user confusion.

In view of the foregoing, it is an object of the present invention to provide records management apparatus for constructing and maintaining a file folder-based document filing and retrieval system that substantially reduces or eliminates the above-mentioned and other problems, limitations and disadvantages typically associated with conventional filing apparatus such as the type representatively described above.

SUMMARY OF THE INVENTION

In carrying out principles of the present invention, in accordance with a preferred embodiment thereof, a compact, inexpensive records management kit is provided for use in setting up and maintaining a file folder—based document filing and retrieval system. The kit includes three primary components—a file guide book, a file index sheet which may be conveniently stored in a cover pocket portion of the book, and a supply of peel-off type adhesive file folder labels attached to support sheets bound into the file guide book. If desired, the kit may also include an initial supply of manila file folders for use in actually constructing the filing system.

The pages of the file guide book are visually divided into four page sets by differently colored page tabs associated with each set. Each page set comprises a main category page followed by a series of subcategory pages. The differently colored tabs on the four main category pages of the file guide book are captioned "PERSONAL", "FINANCIAL", "INSURANCE" and "LIFESTYLE" in the representative "home/personal" version of the kit illustrated herein, these captions corresponding to the four main filing categories of the kit. Printed on each of the main category pages, under the heading "CATEGORY LISTING" in column form, are subcategory headings and alphanumeric file indicia marks aligned therewith.

Each of the subcategory pages has printed thereon a file indicia mark corresponding to one of the file indicia marks on its associated main category page and color-keyed to the appropriately captioned colored tab of the subcategory page, and a column of representative file content headings under the caption "FILE CONTENTS". These headings comprise suggested contents of a particular subcategory file to be established by the system user. Additionally, printed on at least some of the subcategory pages, under the caption "FILE HELP", is helpful information relating, among other things, to the use of the particular subcategory file.

The file folder labels are in four sets, each set being color-keyed to one of the page tab sets and their associated file indicia marks on the subcategory pages. The labels may be marked with indicia correlating them to appropriate subcategory tabs and file indicia marks in the file guide book.

The file index sheet has printed thereon, in alphabetized column form, various filing system entry content index headings indicative of a variety of commonly encountered, specific document types which would ordinarily be filed in a personal filing system. The number of these entry content index headings substantially exceeds the number of subcategories in the file guide book, and the content index headings provide for very easy entry into the created filing system, even by a user wholly unfamiliar with its organization. Stated in another manner, the index headings comprise multiple listings of commonly used names of items, each of which refers to the same general type of item. This makes the index an easy cross-reference to readily determine which file a given item should be placed in.

Aligned with these entry content index headings are columns of category index heading corresponding to the file guide book main categories, columns of subcategory index headings corresponding to the subcategory headings on each of the main category pages, and subcategory index headings corresponding to the file indicia marks printed on the subcategory pages of the file guide book.

To initially construct a file folder-based document filing and retrieval system using the records management kit, the user first consults the file guide book to set up the initial files to be used. Upon the initial set-up of the filing system, it may only be necessary to establish a few files corresponding to various of the subcategories listed in the file guide book. As previously mentioned, suggested file contents for each particular subcategory file are printed on each of the subcategory pages in the guide book. Additionally, on various of the subcategory pages the "file help" information can be consulted to give the file user helpful tips in actually using and organizing the particular subcategory file.

Once an initial set of files is decided upon, the user simply transfers appropriate color-keyed folder labels to the necessary number of manila file folders and stores the labeled file folders in a file cabinet or other suitable file folder storage container. An initial batch of documents may then be sorted and placed in appropriate ones of these initially established files.

As subsequent documents to be filed are received by the file user, the expanded file entry content portion of the file index sheet is consulted to rapidly identify the file in which the received document should be placed. If such file has not already been established, the file index sheet leads the user to the appropriate subcategory page in the file guide book to readily provide the user with information and helpful hints regarding the content and use of the new file which needs to be established. The colored page tabs on the file guide book rapidly point the user to the correct file label to be placed on the new manila file folder. In turn, the colored label placed on the new file folder readily guides the user to the appropriate page section in the file guide book to obtain additional information about the use and suggested additional content of the newly established file.

In this manner, using the records management kit of the present invention, the initial file user may very rapidly construct and easily maintain and expand the created filing system. The very efficient visual and informational interrelation among the file index sheet, the file guide book and the file folder labels permits the initial user of the filing system to very quickly become familiar with its organization and content.

However, and quite importantly, this unique interrelation among the file index sheet, the file guide book and the colored folder labels also permit a new file user to very rapidly and efficiently enter the created file system to efficiently file or retrieve a document—even if the new user is totally unfamiliar with the organization and content of the filing system. The new user may just as easily and efficiently alter the filing system, using the records management kit, to expand and/or modify the filing system in accordance with subsequent filing needs.

While the records management kit illustrated and described herein is representatively tailored for personal use, it will readily be appreciated that the kit could be modified to make it applicable to a wide variety of business filing applications if desired.

In addition to the above-described advantages of the records management kit of the present invention, it also provides various other advantages over document filing apparatus of conventional design. For example, the kit advantageously eliminates the need for user—creation of file names for a filing system. A wide variety of suggested file names are already incorporated in the kit, thereby eliminating to a very substantial degree the possibility that a subsequent user of the filing system will be confused by the "personalized" organizational theme of a previous user. Further, the greatly expanded and cross-referenced "routing" indicia incorporated in the kit renders it unnecessary in most instances to decide which document to file in which folder. Similarly, it is not necessary to mentally "remember" where a particular document has been filed so that it can be easily and rapidly retrieved. This information is conveniently incorporated, in a standardized, easily usable form, in the kit. Because of this, the potential problems of lengthy document searching time, duplication of files, and misfiling of documents are essentially eliminated. Moreover, the filing system which may be created using the records management kit of the present invention provides for significantly enhanced flexibility of the system. For example, duplicate files can be subsequently added to the system at will, with an identifying name placed after the pre-printed name on the particular file label. Finally, the previous necessity for a single person in the household or office to be responsible for all filing and retrieval is essentially done away with.

DETAILED DESCRIPTION

Figure 4:
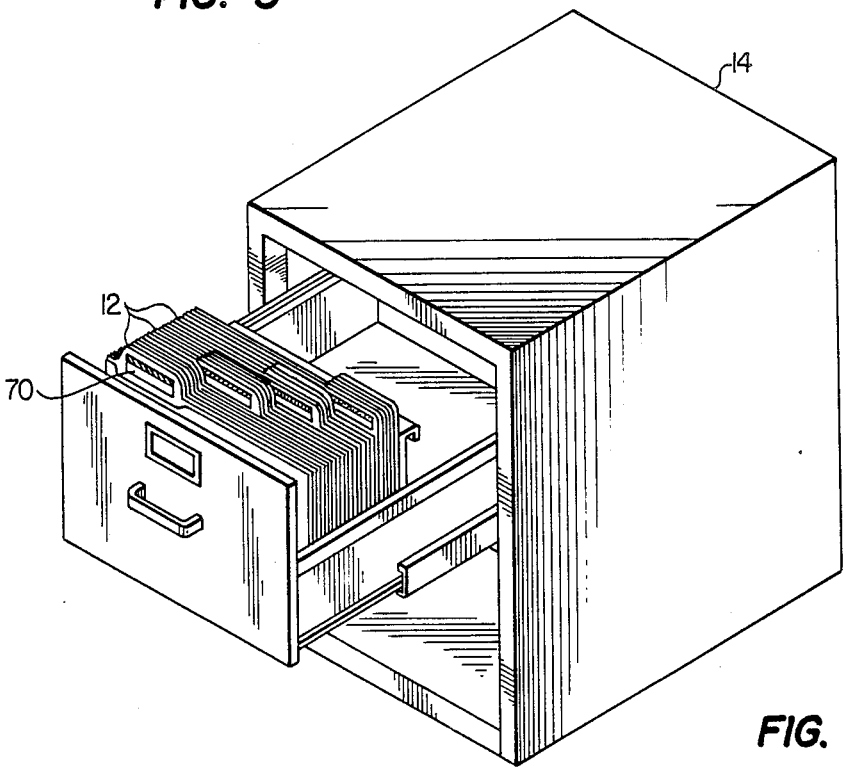
FIG. 4 is a reduced scale perspective view of the file folders, with the labels attached thereto, stored in the usual manner in a representative filing cabinet.

Perspectively illustrated in FIGS. 1A–1D is a records management kit 10 which embodies principles of the present invention and is used to set up and maintain a file folder-based document filing and retrieval system which includes a series of ordinary manila file folders 12 (FIG. 4) that may be stored in a conventional filing cabinet 14 or other suitable folder storage structure. As will be seen, the document filing and retrieval system constructed with the use of kit 10 is quite user friendly, and is rapidly and easily enterable even by a user with no prior familiarity with the system. While the illustrated embodiment of the kit 10 is a "personal/home" version thereof, tailored to meet the varied document filing needs of an individual or family, it will be readily apparent that the kit could be easily modified to permit its use in a variety of business document filing applications.

Figures 1A, 1B, 1C, 1D:
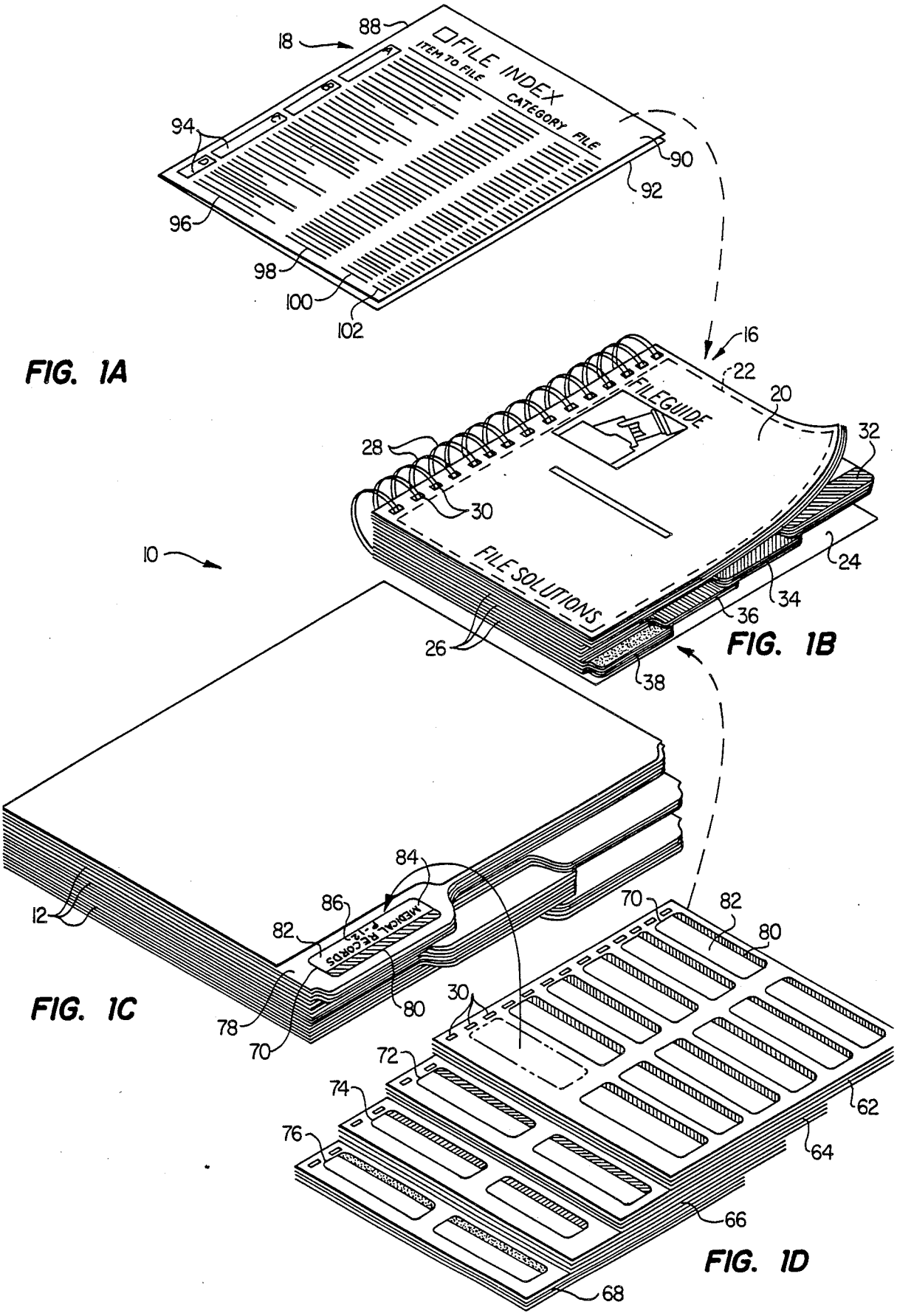
FIGS. 1A–1D are perspective views of portions of a records management kit embodying principles of the present invention, FIG. 1A showing a file index sheet portion of the kit, FIG. 1B showing a file guide book portion of the kit, FIG. 1D showing a file folder label portion of the kit removed from the file guide book, and FIG. 1C showing a file folder portion of the kit.

The kit 10 includes a file guide book 16 (FIG. 1B), a laminated file index sheet 18 (FIG. 1A) and a supply of the manila file folders 12 (Fig. 1C). The file folders 12 are included in the kit 10 as a convenience to its purchaser. However, if desired, they may be omitted from the kit and may be purchased separately by the filing system user.

The file guide book 16 comprises a front cover 20 having an interior side pocket 22 suitably secured thereto, a rear cover 24, and a series of pages 26. The covers 20, 24 and the pages 26 are bound together in a conventional manner by circular binding elements 28 extended through rectangular slots 30 formed through the left side edges of the covers 20 and 24 and the sheets 26.

The pages 26 are visually divided, from front to back within the file guide book 16, into four page sets by four sets of colored tab members 32, 34, 36 and 38 secured to and projecting outwardly from right side edge portions of the pages 26. While different color schemes could be utilized, the tabs 32, 34, 36 and 38 are red, green, blue and yellow, respectively. As illustrated, page tabs of the same color are aligned with one another, and the four color tab sets are staggered along the right side edge of the file guide book 16.

Figure 2:
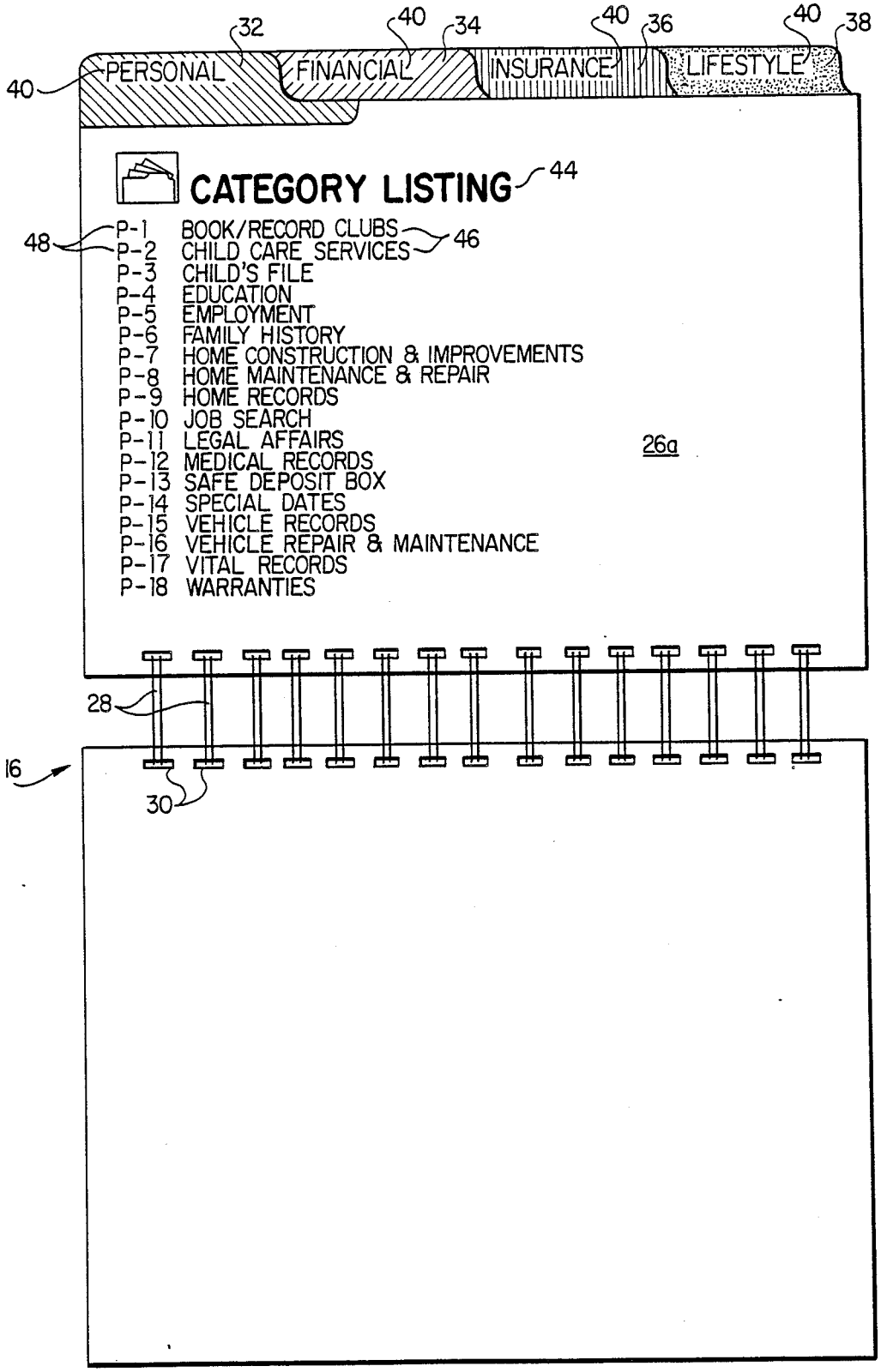
FIG. 2 is an enlarged scale elevational view of the file guide book opened to a main category page thereof.
Figure 3:
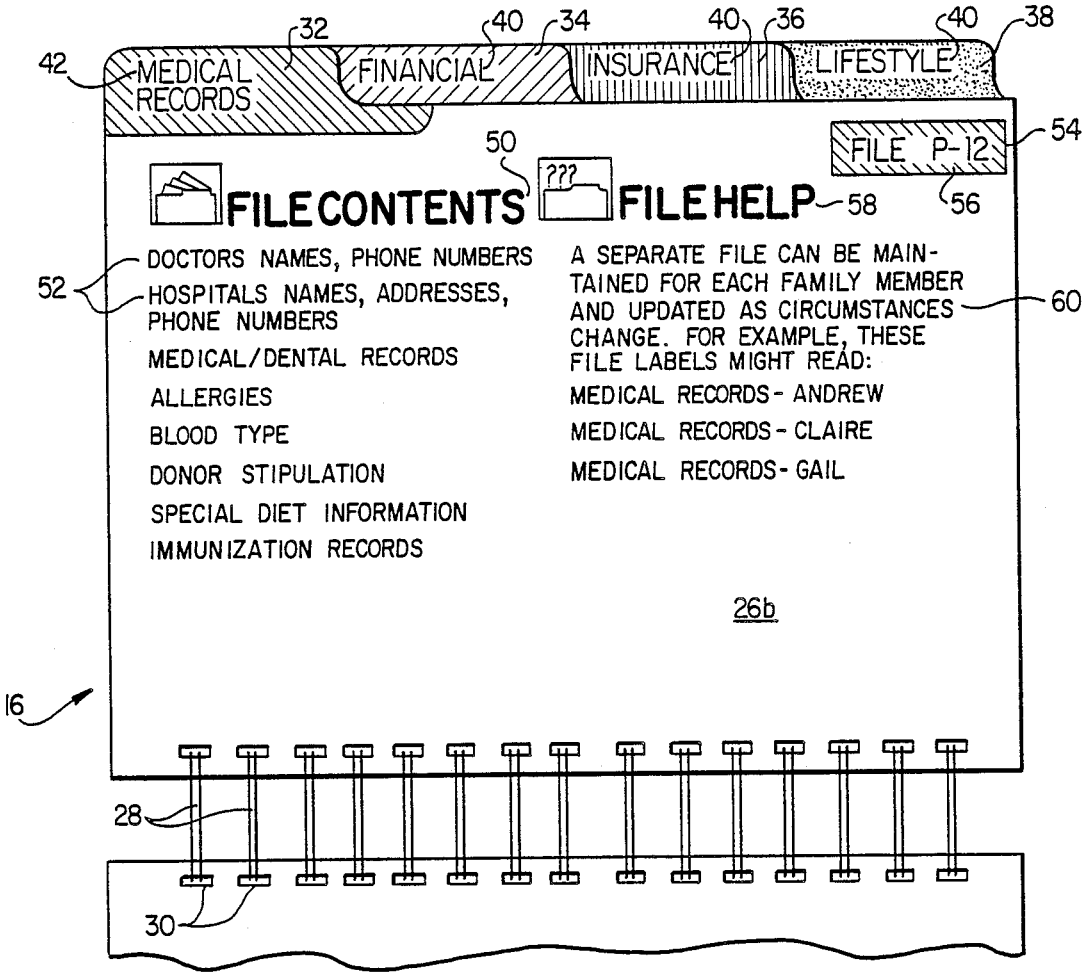
FIG. 3 is an enlarged scale elevational view of a portion of the file guide book opened to a subcategory page thereof.

The front page in each of the four page sets is a main category page **26*a* (FIG. 2), while each subsequent page in the set is a subcategory page 26*b* (FIG. 3). The colored tabs on the main category pages 26*a* have suitably printed thereon page set category headings 40 as illustrated in FIG. 2. While other categories could be used, the page set category headings used in the representative kit 10 include "PERSONAL", "FINANCIAL", "INSURANCE", and "LIFESTYLE". As shown in FIG. 3, the color tab on each subcategory page 26*b* has printed thereon a subcategory heading 42**—for example, the subcategory heading "MEDICAL RECORDS" for the "PERSONAL" main category.

With reference to FIG. 2, each of the main category pages **26*a* has printed thereon a "CATEGORY LISTING" heading 44 positioned above a column of subcategory headings 46. Printed to the left of the subcategory headings 46 is a column of alphanumeric file indicia marks 48, each file indicia mark being aligned with one of the subcategory headings 46**. The illustrated file indicia marks "P-1" through "P-18" include a letter corresponding to the first letter in the associated main category (i.e., "P" for "PERSONAL"), and a corresponding file number.

Referring now to FIG. 3, each of the subcategory pages **26*b* has printed thereon a "FILE CONTENTS" heading 50 under which a series of representative file content headings 52 are printed. As illustrated, the headings 52 are indicative of suggested document types which would logically be included in the "MEDICAL RECORDS" subcategory and its related file. Also printed on each of the subcategory pages 26*b*, in its upper right hand corner as viewed in FIG. 3, is a file indicia mark 54 which is color-keyed to the tab on the particular subcategory page and contains an alphanumerical portion 56 identical to a corresponding file indicia mark 48 (FIG. 2) on the main category page 26*a* with which the particular subcategory page 26*b* is associated. For example, the alphanumeric portion "P-12" of the file indicia mark 54 on page 26*b* in FIG. 3 corresponds to the file indicia mark "P-12" on the illustrated main category page 26*a* in FIG. 2 which is aligned with the "MEDICAL RECORDS" subcategory heading 46**.

Referring again to FIG. 3, at least some of the subcategory pages **26*b* have printed thereon a "FILE HELP" heading 58 under which is printed helpful information 60** relating to, for example, the use of a particular subcategory file to be established.

Also bound into the file guide book 16, behind the category/subcategory page sets therein, are four sets of support sheets 62, 64, 66 and 68. Respectively secured to the support sheet sets 62, 64, 66 and 68 are peel-off type adhesive file folder label sets 70, 72, 74 and 76. As illustrated in FIGS. 1C and 1D, each of these labels may be removed from its associated support sheet and transferred to the tab portion 78 of one of the file folders 12. Each of the labels has, along its top side edge, a bar portion 80 which is color-keyed to one of the page tab sets 32, 34, 36 and 38. Specifically, the bars 80 of the labels 70 are red, the bars 80 of the labels 72 are green, the bars 80 of labels 74 are blue, and the bars 80 of labels 76 are yellow.

Each of the file folder labels also has a space 82 thereon in which a label subcategory heading 84 and a label file indicia mark 86 may be placed. Representatively, the label subcategory heading 84 and the label file indicia mark 86 on the marked label 70 in FIG. 1C correspond to the "P-12 MEDICAL RECORDS" subcategory heading and file indicia marks 46 and 48 on the subcategory page **26*a* in FIG. 2. The spaces 82 on the file folder labels may be pre-printed with appropriate label subcategory headings 84 and label file indicia marks 86, or simply left blank for file user insertion of such indicia therein. Alternatively, some of the label spaces 82** may be preprinted, and the others left blank if desired.

Referring now to FIG. 1A, the laminated file index sheet 18 is centrally folded, as at 88, into two facing page portions 90 and 92. The file index sheet 18 is sized so that in its folded configuration it may be slipped into the cover pocket 22 of the file guide book 16 for storage therein. Printed on the opposite sides of each of the page portions 90, 92 of the file index sheet 18 is a variety of master cross-referencing information which, as will be subsequently described is extremely useful in entering the filing system created with the use of the records management kit 10. In fact, as will also be seen, the use of the file index sheet 18 permits entry into the created filing system by a user having no prior familiarity with the structure and organization of such filing system.

The master cross-referencing information printed on the opposite sides of the file index sheet page portions 90 and 92 includes darkened, alphabetized side bar areas 94 extending down a side edge portion of each sheet side. Immediately to the right of each of these alphabetized side bars are columns of filing system entry content index headings 96, the "A" index headings 96 being to the right of the "A" side bar 94, the "B" index headings 96 being to the right of the "B" side bar 94, and so on. Importantly, these entry content index headings 96 are indicative of a variety of commonly encountered, specific document types which would ordinarily be filed in a personal filing system. The number of these entry content index headings 96 substantially exceeds the number of subcategories in the file guide book 16 and, as will be seen, provide the key to easy entry of the created filing system.

To the right of the filing system entry content index headings 96 is a column of category index headings 98 corresponding to the file guide book main categories "PERSONAL", "FINANCIAL", "INSURANCE", and "LIFESTYLE" and color-keyed in the same manner as previously described. To the right of the category index headings 98 are columns of subcategory index headings 100 which correspond to the subcategory headings 46 on each of the main category pages **26*a* (see FIG. 2) in the file guide book 16. To the right of the subcategory index headings 100 are columns of file indicia index marks 102 which correspond to the file indicia marks 48 also printed on the subcategory pages 26b of the file guide book 16**.

To illustrate the general types of entry content index headings used, which representatively relate to the "PERSONAL" category and the "MEDICAL RECORDS" subcategory, four sample lines from the file index sheet 18 are set forth below:

Allergies, by family member . . . Personal . . . Medical Records . . . P-12

Blood Types . . . Personal . . . Medical Records . . . P-12

Doctors' names/phone numbers . . . Personal . . . Medical Records . . . P-12

Medical/dental records . . . Personal . . . Medical Records . . . P-12

These four representative lines from the file index sheet 18 are respectively positioned to the right of the "A", "B", "D" and "M" side bars 94 on the file index sheet 18. It can be seen that if, for example, a blood type card of a family member is received in the mail and is to be filed, a quick reference to the file index sheet 18 leads the file user to the "blood types" entry content index heading 96 which, in turn, indicates to the file user that the appropriate category is "personal" the subcategory is "medical records", and the file number is "P-12". A similarly easy and rapid entry into the filing system is also provided for documents pertaining to allergies, doctors' names and phone numbers and medical/dental records.

To initially construct the file folder-based documents filing and retrieval system utilizing the records management kit 10, the user first consults the file guide book 16 to set up the initial files to be used. For example, upon the initial set up of the filing system it may be only necessary to establish a few files corresponding to various of the listed subcategories. As previously mentioned, suggested file contents for each particular file are printed on each of the subcategory pages 26b. Additionally, on various of the subcategory pages 26b the "file help" information can be consulted to give the file user helpful tips in actually using and organizing the particular file.

Once an initial set of files is decided upon, the user simply transfers appropriate color-keyed folder labels to the necessary number of manila file folders 12, and stores the labeled file folders in the file cabinet 14 or other suitable container. An initial batch of documents may then be sorted and placed in appropriate ones of these initially established files.

As subsequent documents to be filed are received by the file user, the expanded file entry content portion of the file index sheet 18 is consulted to rapidly identify the file in which the received document should be placed. If such file has not already been established, the file index sheet leads to the appropriate subcategory page in the file guide book 16 to readily provide the user with information and hints regarding the content and use of the new file which needs to be established. The colored page tabs on the file guide book rapidly point the user to the correct file label to be placed on the new manila file folder 12. In turn, the colored label placed on the new file folder readily points the user to the appropriate page section in the file guide book to obtain additional information about the use and suggested additional content of the newly established file.

In this manner, utilizing the kit 10, the initial file user may very rapidly construct and easily maintain and expand, the document filing and retrieval system. The very efficient interrelation among the file index sheet, the file guide book and the file folder labels permits the initial user of the filing system to very quickly become familiar with its organization and content.

However, and quite importantly, this unique visual and informational interrelation among the file index sheet, the file guide book, and the colored folder labels also permits a new file user to very rapidly and efficiently enter the created file system to efficiently file or retrieve a document—even if the new user is, at the outset, totally unfamiliar with the organization and content of the filing system. The new user may just as easily and efficiently alter the filing system, using the kit 10 as previously described, to expand and/or modify the filing system in accordance with subsequent filing needs.

As previously mentioned, the records management kit 10 illustrated and described herein is representatively tailored for personal use. However, it will readily be appreciated that the kit could be modified to make it applicable to a wide variety of business filing applications, if desired, simply by appropriately altering the various cross-referencing indicia contained in the file index sheet, the file guide book and the folder labels and, for example, integrating a chart of accounts for general ledger and bookkeeping purposes.

The foregoing detailed description is to be clearly understood as being given by way of illustration and example only, the spirit and scope of the present invention being limited solely by the appended claims.

What is claimed is:

1. Records management apparatus for use in constructing and maintaining a cross-referenced, easily enterable file folder —based filing and retrieval system, said apparatus comprising:

a number of substantially rectangular pages connected together along one common edge, each page having suitable but similar dimensions to carry visually perceivable written indicia thereon;

a plurality of consecutive, substantially rectangular main category pages included in said number of pages, each main category page being spaced from another main category page by a plurality of said rectangular pages;

a plurality of consecutive, at least substantially uncovered, but visually different, primary tab members, each main category page having one of said primary tab members secured thereto and projecting outwardly therefrom, each consecutive primary tab member being spaced apart from another primary tab member and having suitable dimensions such that each primary tab member is at least substantially uncovered by each adjacent primary tab member, each primary tab member having a different category heading disposed thereon, and each main category page having:

a number of subcategory headings arranged on each category page, each subcategory heading forming a portion of a subset of said different category heading, and a different file indicia mark on each category page adjacent each subcategory heading;

a series of consecutive subcategory pages separating a first one of said main category pages from a second one of said consecutive main category pages, said series of subcategory pages comprising said plurality of rectangular pages spacing each main category page from another, said consecutive main category pages being further included adjacent the first of said number of rectangular pages and spaced throughout said number of rectangular pages to terminate before a remaining plurality of said number of rectangular pages further included in said series of consecutive subcategory pages;

a series of consecutive secondary tab members at least substantially overlapped and covered by each primary tab member, each secondary tab member being secured to, and projecting outwardly from one of said series of consecutive subcategory pages, each secondary tab member having one of said subcategory headings disposed thereon, and each subcategory page having:

an indicia mark thereon correlated to one of said file indicia marks on said first of said category pages, and a series of representative file content headings representing suggested document contents of a file folder dedicated to the filing subcategory of the subcategory page;

a file index sheet associated with said number of rectangular pages, said file index sheet having:

a series of index headings thereon, each index heading forming a part of a subcategory subset of one of said subcategory headings, at least some of said category headings thereon, each index heading further forming a measure of a larger subset of one of said category headings and further being correlated adjacent one of said category headings of which said index heading forms said part, at least some of said subcategory headings thereon, each subcategory heading being correlated adjacent one of said index headings forming said part of its subset, each subcategory heading being further correlated adjacent one of said category headings of which said subcategory heading forms said portion, and at least some of said indicia index marks thereon, each of said indicia marks being correlated adjacent one of said subcategory headings and further corresponding to said subcategory heading; and a series of label sets, each label set being attached to one of said pages separating one of said main category pages from another of said main category pages, each label set visually corresponding to one of said primary tab members, each label set containing a number of individually removable labels.

2. The apparatus of claim 1, wherein said apparatus further comprises a plurality of file folders, each file folder having a space thereon on which one of said removable labels is attached, each of said removable labels having at least one space thereon in which one label subcategory heading and one file indicia mark can be disposed.

3. The apparatus of claim 1, wherein said category headings includes "PERSONAL", "FINANCIAL", "INSURANCE" AND "LIFESTYLE."

4. The apparatus of claim 1, wherein said file index sheet comprises a folded laminated sheet, and wherein said apparatus further comprises a substantially rectangular pocket connected along one common edge to said number of rectangular pages in which said file index sheet is removably retained.

5. The apparatus of claim 1, wherein at least some of said subcategory pages have additionally printed thereon file help information relating to suggested uses of its associated file.

6. A records management kit for use in constructing and maintaining a cross-referenced, easily enterable file folder —based document filing and retrieval system, said kit comprising:

a file guide book having, from front to back therein, a series of page sets each having a main category page and a series of subsequent subcategory pages, each main category page having printed thereon a listing of subcategory headings for the category associated with its page set, a different file indicia mark aligned with each subcategory heading, and a page set category heading positioned on a tab member secured to and projecting outwardly from the main category page, each subcategory page having printed thereon a file indicia mark correlated to one of said file indicia marks on its associated main category page, a subcategory heading positioned on a tab member secured to and projecting outwardly from the subcategory page and corresponding to one of said subcategory headings on the associated main category page, and a series of representative file content headings representing suggested document contents of a file folder dedicated to the filing subcategory of the subcategory page;

at least one file index sheet having printed thereon:

a series of filing system entry content index headings representative of a variety of specific document types which relate generally to the subcategories of said subcategory pages, the number of said filing system entry content index headings substantially exceeding the number of said subcategory pages, each of at least a major portion of said filing system entry content index headings using different terminology than the subcategory to which it generally relates, a series of category index headings each aligned with one of said filing system entry content index headings and corresponding to the main category to which it generally relates, a series of subcategory index headings each aligned with one of the filing system entry content index headings and corresponding to the subcategory to which it generally relates, and a series of file indicia index marks, each aligned with one of said filing system entry content index headings and corresponding to a related one of said subcategory sheet file indicia marks; and a series of file folder label sets each visually correlated to the tab members of a different one of said file guide book page sets, the labels in each set thereof being attachable to a file folder and having spaces thereon in which label subcategory headings and label file indicia marks may be placed that respectively correspond to selected ones of said subcategory headings and file indicia marks on said subcategory pages, whereby, with the marked labels placed on a series of file folders, said at least one index sheet is keyed to both said file guide book and the individual file folders so that the proper file folder for a given document to be filed or retrieved may be rapidly found using said at least one index sheet, and additional information relating to the particular file may be rapidly found in said file guide book using either the marked labels or said at least one index sheet.

7. The records management kit of claim 6 wherein:

at least some of said subcategory pages have additionally printed thereon file help information relating to suggested uses of its associated file.

8. The records management kit of claim 6 further comprising:

a series of file folders to which said labels may be attached.

9. The records management kit of claim 6 wherein:

the tab members associated with each of said page sets are color keyed to the file folder labels in each set thereof.

10. The records management kit of claim 6 wherein:

said kit is for personal use and said page set category headings include "PERSONAL", "FINANCIAL", "INSURANCE" and "LIFESTYLE".

11. The records management kit of claim 6 wherein:

said at least one file index sheet comprises a single laminated sheet.

12. The records management kit of claim 11 wherein:

said single laminated sheet is centrally foldable to a size generally corresponding to the sheet size of said file guide book.

13. The records management kit of claim 12 wherein:

said file guide book has a cover provided interiorly with a pocket, and said single laminated sheet, in its folded configuration, is sized to be received within said pocket.

14. The records management kit of claim 6 wherein:

said file guide book additionally has a series of support sheets secured therein, and said file folder labels are of the peel-off adhesive type and are removably secured to said support sheets.

15. Compact, user-friendly apparatus for use in setting up and maintaining a cross-referenced, easily enterable file folder-based document filing and retrieval system, said apparatus comprising:

a file guide book having, from front to back therein, a series of page sets each having a main category page and a series of subsequent subcategory pages, said file guide book further having a cover with a pocket secured thereto, and a series of support sheets, each main category page having printed thereon a listing of subcategory headings for the category associated with its page set, a different file indicia mark aligned with each subcategory heading, and a page set category heading positioned on a tab member secured to and projecting outwardly from the main category page, each subcategory page having printed thereon a file indicia mark correlated to one of said file indicia marks on its associated main category page, a subcategory heading positioned on a tab member secured to and projecting outwardly from the subcategory page and corresponding to one of said subcategory headings on the associated main category page, and a series of representative file content headings representing suggested document contents of a file folder dedicated to the filing subcategory of the subcategory page;

a file index sheet removably received in said cover pocket and having printed thereon:

a series of filing system entry content index headings representative of a variety of specific document types which relate generally to the subcategories of said subcategory pages, the number of said filing system entry content headings substantially exceeding the number of said subcategory pages, at least a major portion of said filing system entry content index headings using different terminology than the subcategory to which it generally relates, a series of category index headings each aligned with one of said filing system entry content index headings and corresponding to the main category to which it generally relates, a series of subcategory index headings each aligned with one of the filing system entry content index headings and corresponding to the subcategory to which it generally relates, and a series of file indicia index marks, each aligned with one of said filing system entry content index headings and corresponding to a related one of said subcategory page file indicia marks; and a series of file folder label sets each color-keyed to the tab members of one of said page sets, the labels in each set thereof being attachable to a file folder and having spaces thereon in which label subcategory headings and label file indicia marks may be placed that respectively correspond to selected ones of said subcategory headings and file indicia marks on said subcategory pages, said labels being removably secured to said support sheets, whereby, with the marked labels placed on a series of file folders, said index sheet is keyed to both said file guide book and the individual file folders so that the proper file folder for a given document to be filed or retrieved may be rapidly found using said index sheet, and additional information relating to the particular file may be rapidly found in said file guide book using either the marked labels or said index sheet.

16. The apparatus of claim 15 wherein:

at least some of said subcategory pages have additionally printed thereon file help information relating to suggested uses of their associated files.

17. The apparatus of claim 15 further comprising:

a series of file folder to which said labels may be attached.

18. The apparatus of claim 15 wherein:

said apparatus is for personal use and said page set category headings include "PERSONAL", "FINANCIAL", "INSURANCE" and "LIFESTYLE".

19. The apparatus of claim 15 wherein:

said index sheet is laminated and received in a folded orientation within said cover pocket.

* * * * *